US008845269B2

(12) United States Patent
Agneray et al.

(10) Patent No.: US 8,845,269 B2
(45) Date of Patent: Sep. 30, 2014

(54) COMPRESSOR CASING WITH OPTIMIZED CAVITIES

(75) Inventors: Xavier Jean Yves Alain Agneray, Veneux les Sablons (FR); Jerome Jean Bert, Paris (FR); Alexandre Franck Arnaud Chartoire, Paris (FR); Armel Touyeras, Combs la Ville (FR)

(73) Assignee: SNECMA, Paris (FR)

( * ) Notice: Subject to any disclaimer, the term of this patent is extended or adjusted under 35 U.S.C. 154(b) by 681 days.

(21) Appl. No.: 13/141,900

(22) PCT Filed: Dec. 16, 2009

(86) PCT No.: PCT/EP2009/067326
§ 371 (c)(1),
(2), (4) Date: Sep. 13, 2011

(87) PCT Pub. No.: WO2010/072638
PCT Pub. Date: Jul. 1, 2010

(65) Prior Publication Data

US 2012/0003085 A1 Jan. 5, 2012

(30) Foreign Application Priority Data

Dec. 23, 2008 (FR) ..... 08 58990

(51) Int. Cl.

| | |
|---|---|
| ***F01D 25/24*** | (2006.01) |
| ***F04D 29/68*** | (2006.01) |
| ***F04D 27/02*** | (2006.01) |
| ***F04D 29/54*** | (2006.01) |

(52) U.S. Cl.
CPC ..... *F04D 29/681* (2013.01); *F04D 27/0207* (2013.01); *F04D 29/547* (2013.01); *Y10S 415/914* (2013.01)
USPC ..... 415/58.5; 415/220; 415/914

(58) Field of Classification Search
USPC ..... 415/58.5, 220, 914
See application file for complete search history.

(56) References Cited

U.S. PATENT DOCUMENTS

| | | | |
|---|---|---|---|
| 5,762,470 | A | 6/1998 | Gelmedov et al. |
| 6,585,479 | B2 * | 7/2003 | Torrance ..... 415/58.5 |

(Continued)

FOREIGN PATENT DOCUMENTS

| | | |
|---|---|---|
| DE | 103 30 084 | 3/2004 |
| DE | 10 2007 056 953 | 5/2009 |

(Continued)

OTHER PUBLICATIONS

International Search Report issued Feb. 12, 2010 in PCT/EP09/067326 filed Dec. 16, 2009.

*Primary Examiner* — Ninh H Nguyen
(74) *Attorney, Agent, or Firm* — Oblon, Spivak, McClelland, Maier & Neustadt, L.L.P.

(57) ABSTRACT

The invention relates to a compressor for a turbine engine including a casing (4), at least one compressor stage consisting of a stationary blade (2) impeller and a mobile blade (1) impeller positioned upstream from said stationary blade (2) impeller, and cavities (5) made in said casing opposite the through-path of the mobile blades (1), said cavities having a length L2 measured axially and being shifted upstream relative to the blades (1) so as to generate an overlap with a length L1, characterized in that the lengths L1 and L2 are respectively between 35% and 50% and between 80% and 90% of the axial chord $C_{ax}$ measured at the outer end of the blades (1), and in that the cavities (5) do not in communication with one another.

15 Claims, 3 Drawing Sheets

(56) References Cited

U.S. PATENT DOCUMENTS

| | | | | |
|---|---|---|---|---|
| 6,742,983 | B2 * | 6/2004 | Schmuecker | 415/1 |
| 7,766,614 | B2 * | 8/2010 | Northfield | 415/200 |
| 8,066,471 | B2 * | 11/2011 | Bayere et al. | 415/58.5 |
| 8,419,355 | B2 * | 4/2013 | Guemmer et al. | 415/173.1 |
| 2008/0206040 | A1 | 8/2008 | Seitz | |
| 2009/0041576 | A1 | 2/2009 | Guemmer et al. | |
| 2011/0076133 | A1 | 3/2011 | Agneray et al. | |

FOREIGN PATENT DOCUMENTS

| | | |
|---|---|---|
| EP | 2 025 945 | 2/2009 |
| WO | 03 072949 | 9/2003 |

* cited by examiner

COMPRESSOR CASING WITH OPTIMIZED CAVITIES

The field of the present invention is that of propulsion and, more particularly, that of axial or axial-centrifugal compressors for a propulsive assembly (turbojet engine or turboprop, denoted turbine engines in the remainder of the description) and more specifically to highly-loaded high pressure compressors.

Aeronautical turbine engines are principally made up of one or more compressors, in which the air drawn into the air inlet is compressed, a combustion chamber in which the injected fuel is burnt, then a turbine in which the burnt gases are relieved of pressure to drive the compressor(s) and finally an ejection device. Aeronautical compressors are made up of fins, or blades, which are moved in rotation inside a casing which ensures the seal of the air flow passage relative to the outside of the engine. It is known that the clearance existing between the ends of the mobile blades of the compressor and the casing forming the internal wall of the air flow passage impairs the efficiency of the engine of the turbine engine. Moreover, this clearance may considerably change and impair the operation of the compressor leading to the appearance of a "surge" phenomenon which results from the detachment of the air flow from the surface of the blades. The control of the circulation of air at the tip of the blades thus constitutes a fundamental issue in terms of obtaining both good aerodynamic efficiency of the compressor and a sufficient margin against the surge phenomenon.

One developed approach to limit the impact of this parasitic flow between the end of the blade and the casing consists in hollowing-out cavities arranged in the wall of the casing in the region of the through-path of the blades. Said cavities are placed opposite the blade or offset axially, in the upstream direction of the engine, in order to reinject air circulating into the clearance between the blade and the casing, in the flow passage in line with or upstream of the blade in question. Several shapes have been proposed for said cavities, as disclosed in the U.S. Pat. No. 5,137,419 which claims an optimum value for the ratio between the width of the solid part of the casing between two consecutive cavities and the width of the cavity. Other approaches are set forth in the invention U.S. Pat. No. 6,935,833 but are of complex shape and have the drawback of incorporating specific components, which are difficult to produce and thus unsuitable for an industrial application of the design. Nevertheless, it is apparent that other improvements may still be made regarding the possible arrangements and shapes of said cavities.

The document U.S. Pat. No. 5,762,470 discloses a casing with an annular cavity in communication with the flow passage via a series of slots, specifying the optimum geometry for the cavity and for the slots; it does not specify which is the relative position for the cavities relative to the blade. It further discloses an annular cavity 3, set back from the flow passage and sealed by a grooved grille 3B, of which the purpose is to permit the dissipation of losses in the circumferential direction. This configuration has the drawback of a risk of parasitic reinjection in the region of the blade, via a slot 5 adjacent to the slot in question, which impairs performance.

Finally, the documents DE 210330084 and WO 03/072949 disclose an annular cavity comprising a succession of fixed blades extending in the direction of the flow passage.

The object of the present invention is to remedy these drawbacks by proposing a casing for a compressor provided with cavities, for improved aerodynamic performance.

To this end, the subject of the invention is a compressor for a turbine engine comprising a casing, at least one compressor stage consisting of a fixed blade impeller and a mobile blade impeller positioned downstream of said fixed blade impeller and cavities hollowed-out in said casing opposite the through-path of the mobile blades, said cavities having a length L2 measured axially and being offset upstream relative to the mobile blades so as to generate an overlap having a length L1, characterized in that the lengths L1 and L2 are respectively between 35% and 50% and between 80% and 90% of the axial cord $C_{ax}$ measured at the outer end of the mobile blades and in that the cavities do not communicate with one another.

This configuration provides both good suction of air into the cavity and reinjection at a point which is as far upstream as possible of the clearance of the mobile blades. Moreover, the fact that the cavities do not communicate with one another eliminates any circumferential recirculation, and thus the risk of a parasitic reinjection in the region of the blade which could originate from the adjacent cavity and which could penalize the performance of the compressor. The reinjection is carried out exclusively at a point which is as far upstream as possible of the clearance of the blades.

Preferably, the upstream end of the cavities forms in the plane of symmetry of the cavity an angle $\phi$ for the reinjection of air, equal to 90°, plus or minus 5°, with the part of the casing located upstream of said cavity. This makes it possible to avoid internal recirculation in the cavity which would be detrimental to the efficiency of the compressor.

According to the preferred features:

- the number of cavities on the circumference of the casing, relative to the number of mobile blades of the corresponding impeller, is between 2 and 4.
- the cavities are hollowed-out in the casing with an inclination relative to the plane tangent to the flow passage of between 45° and 60° in the direction of rotation of the blades.
- the cavities are distributed uniformly over the circumference of the casing.
- the cavities are distributed non-uniformly over the circumference of the casing, in particular at the ends of each of the two half-shells which make up the casing.
- the casing comprises a local set-back region of the flow passage opposite the mobile blade impeller.
- the upstream end of said set-back region of the flow passage is located in the region of the upstream end of the cavity.
- the downstream end of said set-back region of the flow passage is located in the region of, or slightly downstream of, the trailing edge of the mobile blades.
- the cavities are formed either directly in the casing, or in an attached part, fixed to said casing.

The invention also relates to a turbine engine comprising a compressor having at least one of the features disclosed above.

The invention will be understood more easily and further objects, details, features and advantages thereof will appear more clearly during the detailed explanatory description which follows of a plurality of embodiments of the invention provided by way of purely illustrative and non-limiting examples, with reference to the accompanying schematic drawings, in which.

Figure 1:
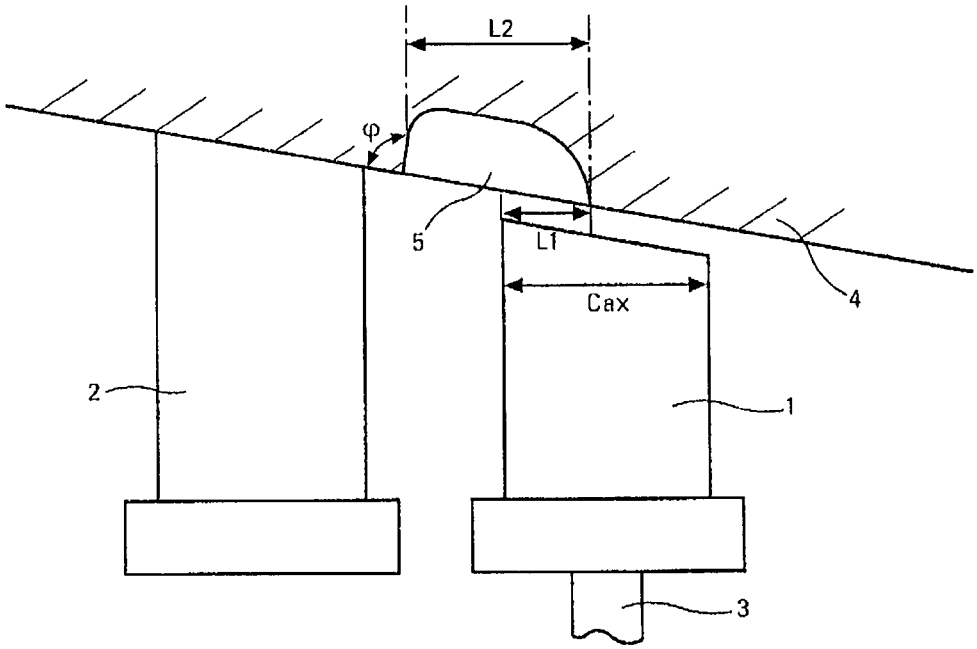
FIG. 1 is a schematic view in longitudinal section of a compressor stage of which the casing has a cavity according to an embodiment of the invention.

With reference to FIG. 1, a compressor stage is seen comprising a stator blade, or fixed blade 2, positioned upstream of a rotor blade, or mobile blade 1, attached to a hub 3, or directly fixed to this hub according to technology known as a one-piece bladed disk or blisk. The fixed blades are held in place by fixing to a compressor casing 4 which surrounds the mobile blades 1, leaving a predefined clearance therewith. The mobile blades have in the region of the casing 4 a cord length $C_{ax}$, measured axially between the most external point of the leading edge and the most external point of the trailing edge.

The casing 4 is hollowed-out with multiple cavities 5 distributed uniformly over its circumference opposite the through-path of the mobile blades 1. Said cavities have, in section, approximately the shape of a rectangle with rounded corners, extending over a length L2. This cavity 5 is offset in the direction upstream of the engine, relative to the leading edge of the mobile blade 1. The length of overlap of the blade 1 by the cavity 5 has a value L1, less than L2. This configuration makes possible the recycling of air which passes into the clearance between the blade and casing; this clearance may in fact be the location of violent turbulence which could deteriorate the configuration of the flow between the different stages and thus impair the performance of the compressor or, in the extreme, cause a phenomenon known as "surge" or "stall" consisting of an immediate drop in the rate of compression and a reversal of the flow of air passing through the compressor which then exits upstream of the compressor. By the positioning of these cavities, the parasitic air is drawn in and reinjected into the flow passage upstream of the blade. The length L2-L1 which the cavity exceeds relative to the leading edge of the blades, is nevertheless limited by the space existing between the mobile blade impeller 1 and the fixed blade impeller 2.

Figure 2:
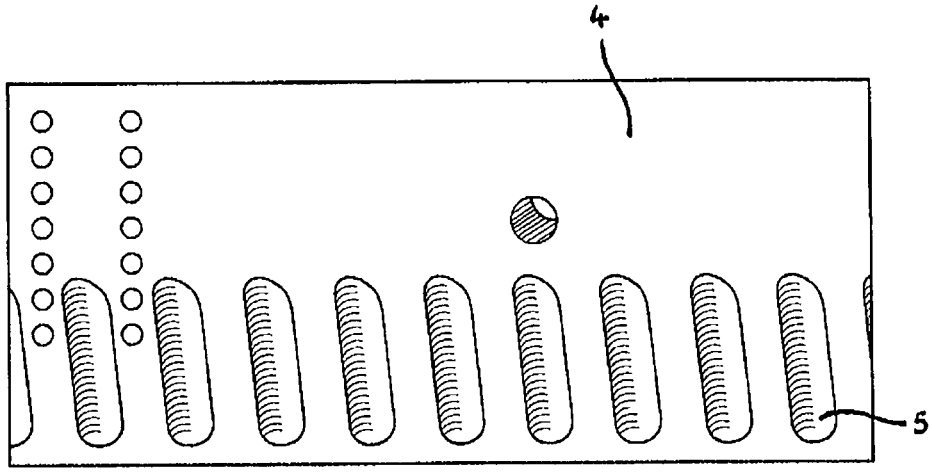
FIG. 2 is a view from the axis of the engine of the cavities of a casing of the compressor.

With reference now to FIG. 2, a series of cavities 5 is seen aligned along the circumference of the casing 4. The axis of these cavities is slightly inclined relative to the longitudinal direction of the engine. The number of cavities is much greater than the number of blades 1 forming the mobile impeller of the compressor stage. This number is, in practice, between 2 and 4 times the number of mobile blades 1. The distribution of the cavities, as shown in FIG. 2, is a uniform distribution; in a version, not shown, the distribution may be made non-uniform to break the aerodynamic excitation on the blade assembly which could be caused by said cavities, in particular at the ends of each of the two half-shells which form the casing.

Figure 3:
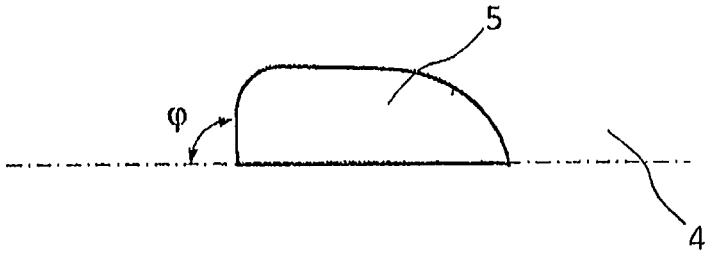
FIG. 3 is a view in cross section of a cavity of a compressor casing according to an embodiment of the invention.
Figure 4:
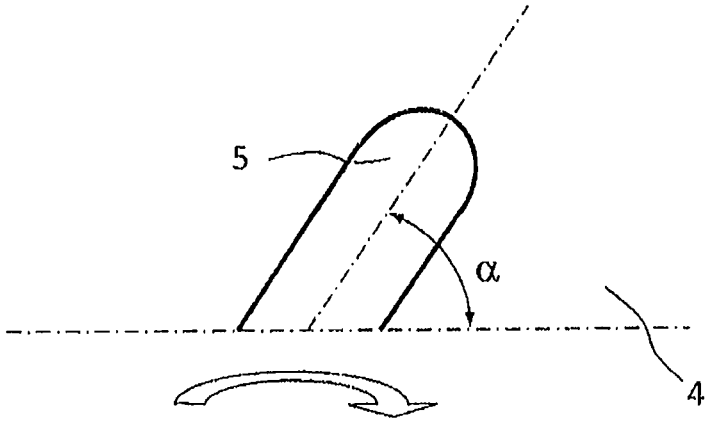
FIG. 4 is a view in section according to its plane of symmetry, of a cavity of a compressor casing according to an embodiment of the invention.

With reference to FIGS. 3 and 4, the preferred shape is seen of the cavities 5 which are hollowed-out in the casing 4.

In cross section, as illustrated in FIG. 4, the cavity 5 has two parallel sides connected at the external end thereof by a semi-circumference. It is forced into the casing 4 in an inclined direction, in the rotational direction of the blades, relative to a direction perpendicular to the plane tangent to the flow passage. A maximum inclination is desirable but it is limited for reasons of production of the casing; in practice the angle of inclination $\alpha$ relative to the plane tangent to the flow passage is between 45° and 60°. The depth of the cavity 5 is defined by the desired aerodynamic characteristics, also taking into account production restrictions.

In section along its plane of symmetry as illustrated in FIG. 3, the cavity 5 has roughly the shape of a rectangle of which the short side, upstream, intersects the casing at an angle $\phi$ measured from the curve of the casing which results from its section through the plane of symmetry of the cavity and which is located upstream of the cavity; this angle $\phi$ is in the region of 90°. The downstream part of the cavity has a substantially circular shape.

Figure 5:
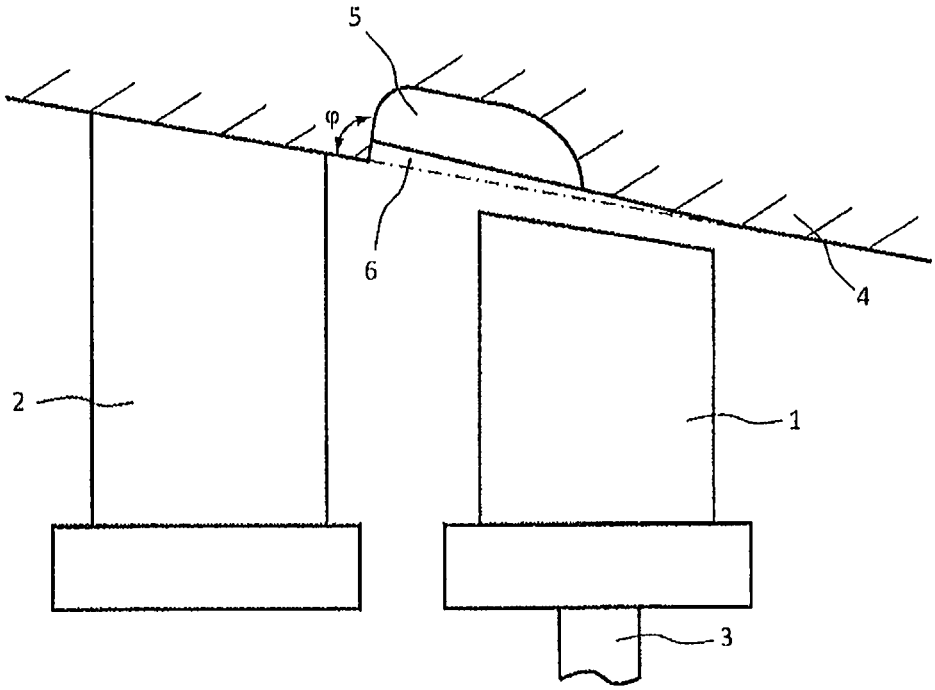
FIG. 5 is a schematic view in longitudinal section of a compressor stage of which the casing has a local set-back region of the flow passage and in which a cavity is hollowed-out according to an embodiment of the invention.

FIG. 5 shows the circumstances of a casing 4 having a local set-back region of the flow passage 6 in the region of the mobile blades 1 known commonly as the "trench". As shown, this set-back region is reduced as it is displaced downstream of the engine. This type of casing is also capable of receiving cavities 5 of the type as disclosed above. The local set-back region of the flow passage 6 starts in this case in the region of, or downstream of, the upstream end of the cavity 5 and is terminated in the region of, or slightly downstream of, the trailing edge of the mobile blades 1.

The invention relates to an optimization of the geometric features of the cavities 5 and the positioning thereof relative to the mobile blades 1. It permits a very significant improvement in the ability to operate the compressor (in terms of efficiency and surge margin) due to its control of the flow in the clearance between the blades and the casing and its reinjection upstream of the mobile blade impeller 1. This improvement is particularly relevant within the context of a highly-loaded compressor, having blades of three-dimensional shape (forward swept blades) and reduced inter-stage distances in order to limit the total length of the compressor.

The downstream shape of the cavity 5 where the fluid is drawn in is optimized for improved guidance of the fluid upstream, and its upstream shape is optimized to ensure reinjection into the flow passage as close as possible to the radial direction. Its length is optimized to provide the reinjection of the fluid at a point as far as possible upstream of the blade.

These optimal characteristics are:

- a length L1 of between 35% and 50% of the length of the cord $C_{ax}$. This overlap makes it possible to limit the impaired efficiency which reduces considerably when the overlap increases, whilst maintaining correct suction of the fluid.
- a length L2 of between 80% and 90%, of the length of the cord $C_{ax}$. This length which, however, remains limited by the axial bulk makes it possible to ensure suction in the optimal position of the blade assembly and reinjection which is sufficiently far removed upstream of the leading edge, and which is translated by reduced local interference.
- a reinjection angle $\phi$ equal to 90°, plus or minus 5°. The analysis has shown that with an angle greater than this value the cavity 5 causes a zone of aerodynamic obstruction to be formed, which causes loss of efficiency and, with an angle substantially less than this value, counter-rotating secondary vortex flow appears in the cavity 5 which reduces the recirculation therein.
- a circular-arc downstream end, of which the radius is substantially equal to that of the depth of the cavity.

The efficiency of the present invention, therefore, results from the combination of limited axial overlap of the blade and reinjection upstream of the blade at an optimized angle. The assembly improves the efficiency of the compressor in stabilized operating conditions and when subjected to strong aerodynamic action, between the nominal operating line and the stability limit (or surge line) of the compressor. This results from the fact that the local losses in efficiency caused by the offset L1 are compensated by the gain achieved by controlling the recirculation of air.

The association of cavities 5 as disclosed above and a local set-back region of the flow passage 6 further improves the performance in terms of the efficiency of the compressor.

Further variants are possible such as, for example, cavities associated with an abradable deposition to permit blade/casing contacts of limited intensity. The cavities may be machined directly into the casing or positioned via a surfacing technique by a specific attached part, fixed to the casing.

Finally, this technique is applicable to any type of compressor, whether it is axial or centrifugal and designed for a turbojet engine or a turboprop.

Although the invention has been disclosed in relation to a particular embodiment, it is obvious that it is not in any way limiting and that it comprises all the technical equivalents of the means disclosed and the combinations thereof, provided they come within the scope of the invention.

The invention claimed is:

1. A compressor for a turbine engine comprising:

a casing;

at least one compressor stage including a fixed blade impeller and a mobile blade impeller that includes mobile blades that are forward swept, and the mobile blade impeller is positioned downstream of said fixed blade impeller; and cavities hollowed-out in said casing opposite a through-path of the mobile blades, said cavities having a length L2 measured axially and being offset upstream relative to the mobile blades so as to generate an overlap having a length L1, wherein the lengths L1 and L2 are respectively between 35% and 50% and between 80% and 90% of an axial cord $C_{ax}$ measured at an outer end of the mobile blades and in that the cavities do not communicate with one another, and wherein an upstream end of the cavities forms in a plane of symmetry of a cavity an angle $\phi$ for reinjection of air, equal to 90°, plus or minus 5°, with a part of the casing located upstream of said cavity.

2. The compressor as claimed in claim 1, wherein a downstream end of the cavities has a circular-arc profile, of which a radius is substantially equal to a depth of said cavity.

3. The compressor as claimed in claim 1, wherein a number of cavities on a circumference of the casing, relative to a number of mobile blades of the corresponding impeller, is between 2 and 4.

4. The compressor as claimed in claim 1, wherein the cavities are hollowed-out in the casing with an inclination relative to a plane tangent to a flow passage of between 45° and 60° in a direction of rotation of the blades.

5. The compressor as claimed in claim 1, wherein the cavities are distributed uniformly over a circumference of the casing.

6. The compressor as claimed in claim 1, wherein the cavities are distributed non-uniformly over a circumference of the casing.

7. The compressor as claimed in claim 1, wherein the casing comprises a local set-back region of a flow passage opposite the mobile blade impeller.

8. The compressor as claimed in claim 7, wherein an upstream end of the set-back region of the flow passage is located in a region of the upstream end of the cavity.

9. The compressor as claimed in claim 7, wherein a downstream end of the set-back region of the flow passage is located in a region of, or slightly downstream of, a trailing edge of the mobile blades.

10. The compressor as claimed in claim 1, wherein the cavities are formed directly in the casing.

11. The compressor as claimed in claim 1, wherein the cavities are formed in an attached part, fixed to said casing.

12. A turbine engine comprising a compressor as claimed in claim 1.

13. A compressor for a turbine engine comprising:

a casing;

at least one compressor stage including a fixed blade impeller and a mobile blade impeller positioned downstream of said fixed blade impeller; and cavities hollowed-out in said casing opposite a through-path of mobile blades, said cavities having a length L2 measured axially and being offset upstream relative to the mobile blades so as to generate an overlap having a length L1, wherein the lengths L1 and L2 are respectively between 35% and 50% and between 80% and 90% of an axial cord $C_{ax}$ measured at an outer end of the mobile blades and the cavities do not communicate with one another, and wherein the casing comprises a local set-back region of a flow passage opposite the mobile blade impeller.

14. The compressor as claimed in claim 13, wherein an upstream end of the set-back region of the flow passage is located in a region of the upstream end of the cavity.

15. The compressor as claimed in claim 13, wherein a downstream end of the set-back region of the flow passage is located in a region of, or slightly downstream of, a trailing edge of the mobile blades.

* * * * *

UNITED STATES PATENT AND TRADEMARK OFFICE

CERTIFICATE OF CORRECTION

PATENT NO. : 8,845,269 B2
APPLICATION NO. : 13/141900
DATED : September 30, 2014
INVENTOR(S) : Xavier Jean Agneray et al.

It is certified that error appears in the above-identified patent and that said Letters Patent is hereby corrected as shown below:

In the Claims

In column 5, line 33, claim 1, cancel the text "in that"

Signed and Sealed this
Sixteenth Day of June, 2015

Michelle K. Lee

Michelle K. Lee
*Director of the United States Patent and Trademark Office*